United States Patent [19]

Martin

[11] Patent Number: 4,817,406

[45] Date of Patent: Apr. 4, 1989

[54] LOCK IMPRESSIONING KEY

[76] Inventor: William E. Martin, 499 John Street N., Hamilton, Ontario, Canada, L8L 4R7

[21] Appl. No.: 82,619

[22] Filed: Aug. 7, 1987

[30] Foreign Application Priority Data

Aug. 11, 1986 [GB] United Kingdom ..... 8619522

[51] Int. Cl.[4] ..... E05B 19/20

[52] U.S. Cl. ..... 70/394; 70/395; 76/110

[58] Field of Search ..... 70/394, 395, 409, 410; 33/539, 540; 76/110

[56] References Cited

U.S. PATENT DOCUMENTS 2,763,027 9/1956 Tampke ..... 70/394 X
4,300,416 11/1981 Ross ..... 70/394 X
4,400,956 8/1983 Martin ..... 70/394

FOREIGN PATENT DOCUMENTS 2404089 5/1979 France ..... 70/409
648730 1/1951 United Kingdom ..... 70/395

*Primary Examiner*—Lloyd A. Gall
*Attorney, Agent, or Firm*—Robert F. Delbridge; Arne I. Fors

[57] ABSTRACT

An impressioning key for making an impression of the tumblers of a lock comprises a key blank having a main portion of relatively hard material with a recess in an upper forward edge portion. A tumbler engaging portion consisting substantially wholly of lead is secured to the main portion in the recess, the tumbler engaging portion being a solid pre-shaped body of lead filling the recess.

1 Claim, 1 Drawing Sheet

FIG.1.
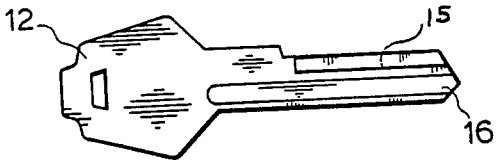
FIG.2.
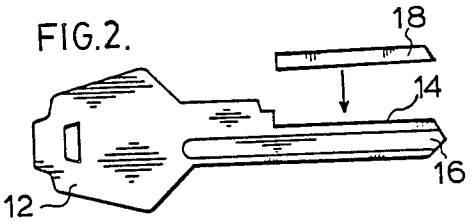
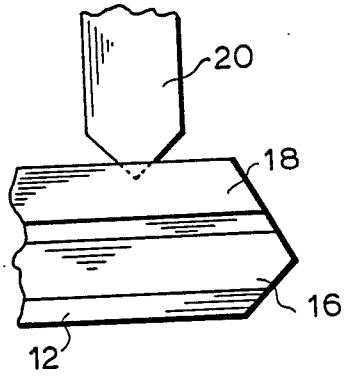
FIG.3.
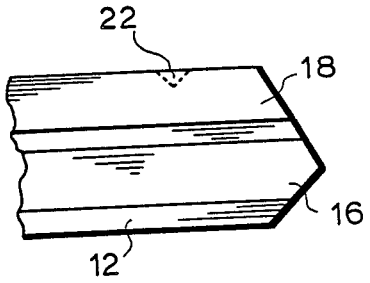
FIG.4.
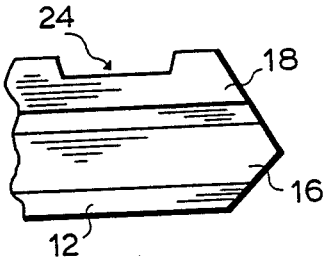
FIG.5.
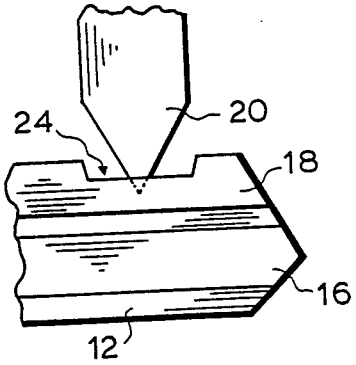
FIG.6.

LOCK IMPRESSIONING KEY

BACKGROUND OF THE INVENTION

This invention relates to impressioning keys, that is to say key blanks which are used to make an impression of the tumblers in a lock so that the lock can be opened and a permanent key made from an impressioned blank.

In theory, a conventional metal key blank can be used as an impressioning key by inserting the blank into a lock, turning the blank until the tumblers are engaged, and then moving the key up and down transversely to its length so that the tumblers produce an impression on the blank. However, the impressions obtained on a conventional key blank are usually barely perceptible and could more properly be described as shine marks. It is thus almost impossible even for a skilled locksmith to "read" the marks and appropriately file away the blank in the region of the marks to produce a first stage impression key, and of course the process has to be repeated until the impressioned key opens the lock. Additionally, a user must develop the skill to file away only one depth increment at a time. Too small a depth means that more filing must be carried out, and too great a depth ruins that particular blank for its intended purpose.

In practice, it has been known for many years to remove the tumbler engaging portion of a key blank and replace the removed portion with solder, usually soft solder with a composition of about 50% tin, 50% lead. Because of the nature of solder, especially its low melting point of about 230° F., a large lump of solder becomes applied to the cut-away blank, and thus large amounts have to be filed away to the shape of the removed portion. Not only is this a tedious procedure, but filing solder quickly clogs up and thus destroys a file. The solder cannot be pre-shaped since it must be melted to weld it to the blank. Also, solder is relatively expensive, and this known procedure is very wasteful of the material.

SUMMARY OF THE INVENTION

It is therefore an object of the invention to provide an improved impressioning key which does not have the abovementioned disadvantages.

According to the present invention, an impressioning key for making an impression of the tumblers of a lock comprises a key blank of conventional construction but with a tumbler engaging portion removed, and a pre-shaped insert consisting essentially of lead secured to the blank in place of the removed portion. The pre-shaped insert may for example be of substantially pure lead or may be of lead with a minor amount of one or two other elements such as antimony as a hardening additive.

The lead insert of the present invention can be conveniently pre-shaped and secured to the blank in any convenient manner, for example by soldering, with there consequently being no wastage of material. Since lead is softer than solder, much better tumbler impressions can be made. Also, lead is relatively inexpensive and does not significantly clog a file.

Impressions produced in the lead insert of the present invention are relatively deep and can virtually be described as holes. The user does not have to be concerned with filing away only one tumbler depth increment. For the present invention, an impression hole is filed away until the filed cut reaches the bottom of the impression, i.e. until the impression disappears. In practice, after a series of insertions of the key in the lock and the subsequent filing, the lock tumblers will dig down to their opening levels and stop. The user in effect facilitates this procedure by filing any excess lead from the blank around the impression holes.

BRIEF DESCRIPTION OF THE DRAWING

One embodiment of the invention will now be described, by way of example, with reference to the accompanying drawings, in which:

FIG. 1 is a side view of an impressioning key in accordance with the invention,

FIG. 2 is an exploded view of the key showing the blank and the pre-shaped lead insert before assembly, FIG. 3 is a diagrammatic side view of a tumbler digging into the lead insert, FIG. 4 is a similar view showing the resultant dig mark, FIG. 5 is a similar view showing the insert after filing down to the bottom of the dig mark, and FIG. 6 is a similar view showing a tumbler making a subsequent dig mark.

DESCRIPTION OF THE PREFERRED EMBODIMENT

Referring to the drawings, an impressioning key in accordance with the invention comprises a conventional steel key blank 12 with a tumbler engaging portion removed to leave a recess 14, the blank 12 having a conventional longitudinally extending groove 16 below the recess 14. A lead insert 18 is pre-shaped to the same shape as the removed tumbler engaging portion and is then soldered 15 in place in the recess 14.

In use, the key is inserted into a lock and turned and moved up and down to cause the tumblers to make impressions in the lead insert 18 as indicated in FIG. 3. For convenience, only one tumbler 20 is shown. FIG. 4 shows the resultant dig mark or hole 22. The lead insert 18 is then filed in a transverse direction across each dig mark 22 until the depth of the filed groove 24 equals that of the dig mark 22 i.e. until the dig mark 22 has disappeared, as shown in FIG. 5. The key is then again inserted into the lock to cause the tumblers 20 to make further dig marks in the grooves 24 as shown in FIG. 6, and the process is repeated until no further dig marks appear, at which time the lead insert 18 will be shaped to open the lock and will be suitable for use in making a replacement key.

As described earlier, the lead insert 18 has significant advantages over the prior art, and such advantages will be clear to a person skilled in the art from the foregoing description. Other embodiments of the invention will also be readily apparent to a person skilled in the art.

What I claim as new and desire to protect by Letters Patent of the United States is:

1. An impressioning key for making an impression of the tumblers of a lock, comprising a key blank having a main portion of relatively hard material, said main portion having a recess in an upper forward edge portion, and a tumbler engaging portion consisting substantially wholly of lead secured to the main portion in the recess, said tumbler engaging portion being a solid pre-shaped body of lead filling the recess, wherein the tumbler engaging portion is separately soldered to the main portion.

* * * * *